US005283917A

United States Patent [19]

Dietze

[11] Patent Number: 5,283,917

[45] Date of Patent: Feb. 8, 1994

[54] APPLIANCE FOR LIFTING OR POSITIONING A SICK OR HANDICAPPED PERSON

[76] Inventor: Werner Dietze, Heinrich-Fuchs-Str. 7, 6900 Heidelberg, Fed. Rep. of Germany

[21] Appl. No.: 937,854

[22] PCT Filed: Apr. 16, 1991

[86] PCT No.: PCT/DE91/00317

§ 371 Date: Oct. 6, 1992

§ 102(e) Date: Oct. 6, 1992

[87] PCT Pub. No.: WO91/16028

PCT Pub. Date: Oct. 31, 1991

[30] Foreign Application Priority Data

Apr. 18, 1990 [DE] Fed. Rep. of Germany ..... 4012308

[51] Int. Cl.[5] ..... A61G 7/10

[52] U.S. Cl. ..... 5/83.1; 5/86.1; 5/87.1

[58] Field of Search ..... 5/81.1-87.1

[56] References Cited

U.S. PATENT DOCUMENTS

| | | | |
|---|---|---|---|
| 2,213,204 | 6/1940 | Nicolai | 5/83.1 |
| 2,261,297 | 11/1941 | Sieb . | |
| 2,975,434 | 3/1961 | Butler et al. | 5/86.1 |
| 3,131,404 | 5/1964 | Bowers et al. . | |
| 3,882,555 | 5/1975 | Edlund | 5/81.1 |
| 4,837,874 | 6/1989 | Giercarz et al. . | |

FOREIGN PATENT DOCUMENTS

| | | |
|---|---|---|
| 836236 | 4/1952 | Fed. Rep. of Germany . |
| 1541340 | 9/1969 | Fed. Rep. of Germany . |
| 8906752 | 10/1989 | Fed. Rep. of Germany . |

*Primary Examiner*—Michael F. Trettel

*Attorney, Agent, or Firm*—Sprung Horn Kramer & Woods

[57] ABSTRACT

An apparatus for lifting or positioning a sick or handicapped person has a multiplicity of support elements for the person which are connected to a base by a positioning device. The positioning device is fitted with a lifting or pivot drive. The support elements are fastened to multi-hinge supporting arms, each with at least three hinges which are hinged to the positioning device and wherein at least two of the hinges are continuously lockable.

22 Claims, 4 Drawing Sheets

APPLIANCE FOR LIFTING OR POSITIONING A SICK OR HANDICAPPED PERSON

Figure 1:
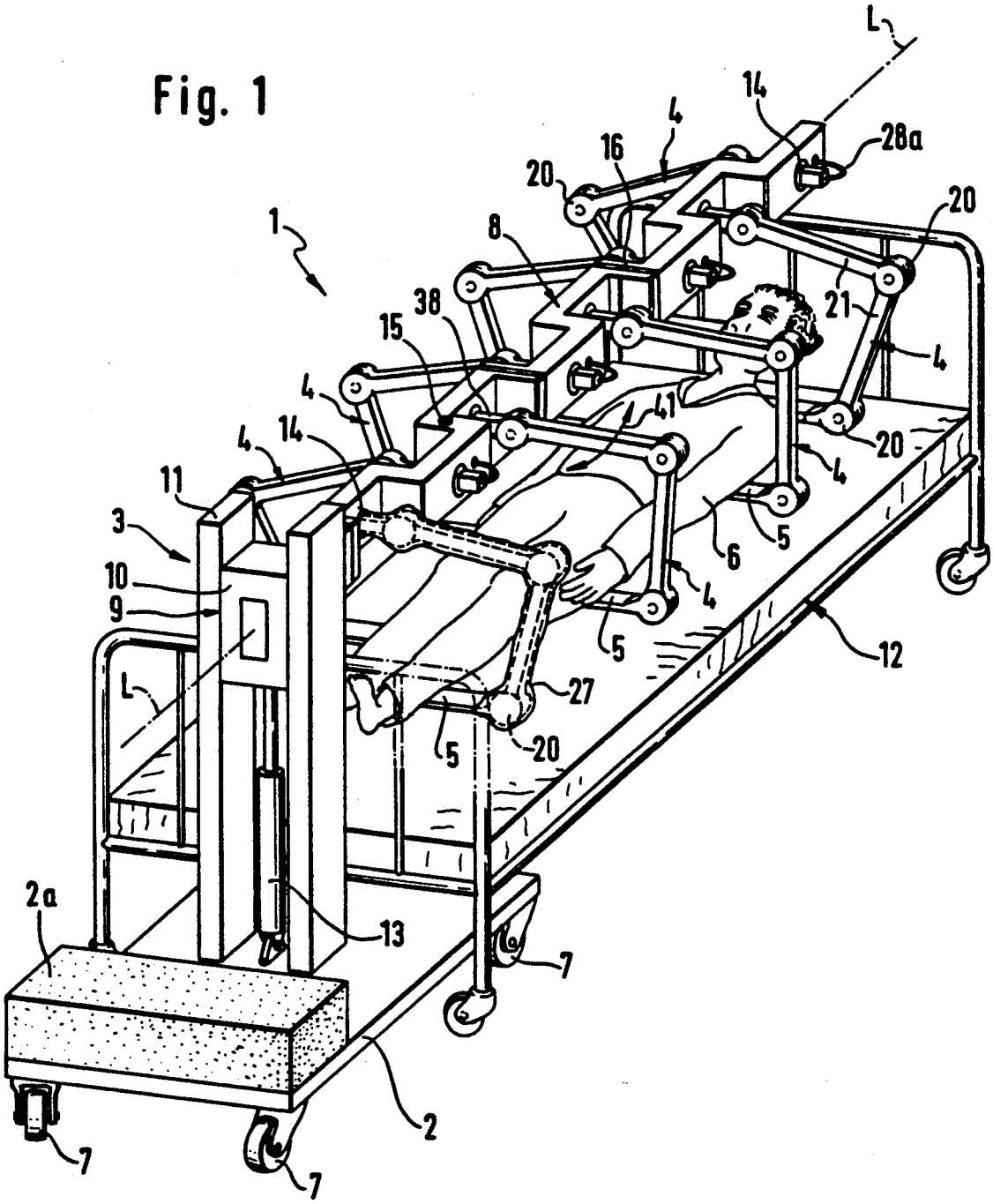

The invention concerns an appliance for lifting or positioning a sick or handicapped person (patient), comprising a base, a multiplicity of supporting elements for the body of the patient and a positioning device connecting the base to the supporting elements.

In the course of care and treatment of patients substantially unable to move, it is often difficult to bring them into whatever may be the position required with as little pain as possible. This applies particularly to lifting the patient or moving her/him from one bed to another to re-make the bed or when measures of personal hygiene are required Another example is, positioning the whole patient or certain parts of the body for diagnostic or therapeutic purposes including surgery.

Particularly for the first-mentioned application, a multitude of different appliances have already been proposed. The base can usually be moved along the floor on wheels; the support elements can be pushed under the body of the patient. Base and support elements are connected by mechanical and/or hydraulic and/or electrical means collectively designated as positioning equipment or lifting equipment, insofar as it is a matter of lifting the patient.

Examples of such appliances are described in German Patent Specification 836 236 and in DE-Ul-89 06 752. These appliances are of complicated design. They are also awkward to use because the support elements in the form of straps or slats are difficult to position and have to be fixed individually. Usually the appliances comprise a large number of parts difficult to keep clean.

Also already proposed a long time ago have been supporting arms which can be pivoted about an axis roughly parallel to the longitudinal axis of the patient. In U.S. Pat. No. 2,261,297 (issued in 1941) the supporting arms can be slid around two separate longitudinal beams of a frame movable over a bed. Each of the arms comprises a suspending shank and a support member for the body of the patient. These two parts can be rotated in relation to each other and are lockable in two positions, namely at right angles to one another (to form the relatively-angled operating position) and extended. This is achieved by means of a pin engaging in a drilled hole.

In DE-A-1 541 340 an appliance is described whose object is above all to reduce the exposure to radiation of the nursing staff when dealing with a patient receiving radiation treatment. It has several rigid supporting arms fastened in swivelling fashion via a swivel hinge to a cantilever beam arranged over the longitudinal axis of the patient.

Starting from this basis, the purpose of the invention is to make available an appliance for positioning (in particular, for lifting) patients which is easy to use and comfortable for the patient.

In the case of an appliance of the type mentioned initially this purpose is achieved by having support elements fastened to multi-hinge supporting arms each with at least three hinges, of which at least two are continuously lockable, i.e. can be locked in any desired position within the respective swivelling range.

An important basis of the invention is the recognition that simpler operation of the appliance by the nursing staff, but above all gentler and less unpleasant lifting or positioning of the patient, can be achieved if the supporting arms are movable in such a way that they can be inserted under the patient either horizontally or at various different angles to the horizontal as required by the patient's position, the level of the insertion-movement (relative to the top surface of the bed) also being adjustable to match the position in which the patient is lying. This makes it possible to bring each of the support elements (which themselves may be variously shaped to match their specific purpose) into the optimum position with little effort and gently. In the case of the currently known designs, which merely permit pivoting of the supporting arms about a fixed axis, this is not ensured. The infinitely variable locking facility allows each support element to be fixed in the position most comfortable for the patient. Once all the multi-hinge supporting arms have been locked, the patient is brought to the desired position using the positioning equipment.

Particularly simple operation is achieved if, according to a preferred version of the invention, locking of the hinges is effected using an auxiliary (particularly electrical, hydraulic or pneumatic) energy source. Preferably, a central actuating unit is provided for locking the arm hinges.

The hinges used may either be simple articulated ones (with a single degree of freedom) or more complicated universal or ball-and-socket hinges (with two or three degrees of freedom). Preferably the individual hinges each have only one degree of freedom, being thus relatively simple in design and reliably lockable. The axes of the hinges of any one supporting arm as a rule run parallel to one another. However, to enable more complex adjustments to be made it may also be expedient to employ hinges with axes running in different directions in space in one multi-hinge supporting arm. Not all support elements have to be fastened to a multi-hinge supporting arm.

Preferably the lockable hinges are so fashioned that the two hinge elements which the hinge unites each have locking surfaces which slide over one another during movement of the hinge. A hinge of this type is locked by pressing the locking surfaces against one another. These surfaces are preferably located on interlocking lamellar discs rotatable in relation to each other about a common axis, together forming a lamellae pack. In a further development, the discs are advantageously perforated with a central perforation. Generally speaking there is a preference for ring-shaped locking surfaces, with the forces pressing them together concentrated on regions relatively remote from the axis.

This design of hinge is also of significance in the field of medicine beyond its application for positioning patients with the above-mentioned appliances, particularly for positioning auxiliary devices with the aid of a supporting arm embodying several lockable hinges.

Figure 2:
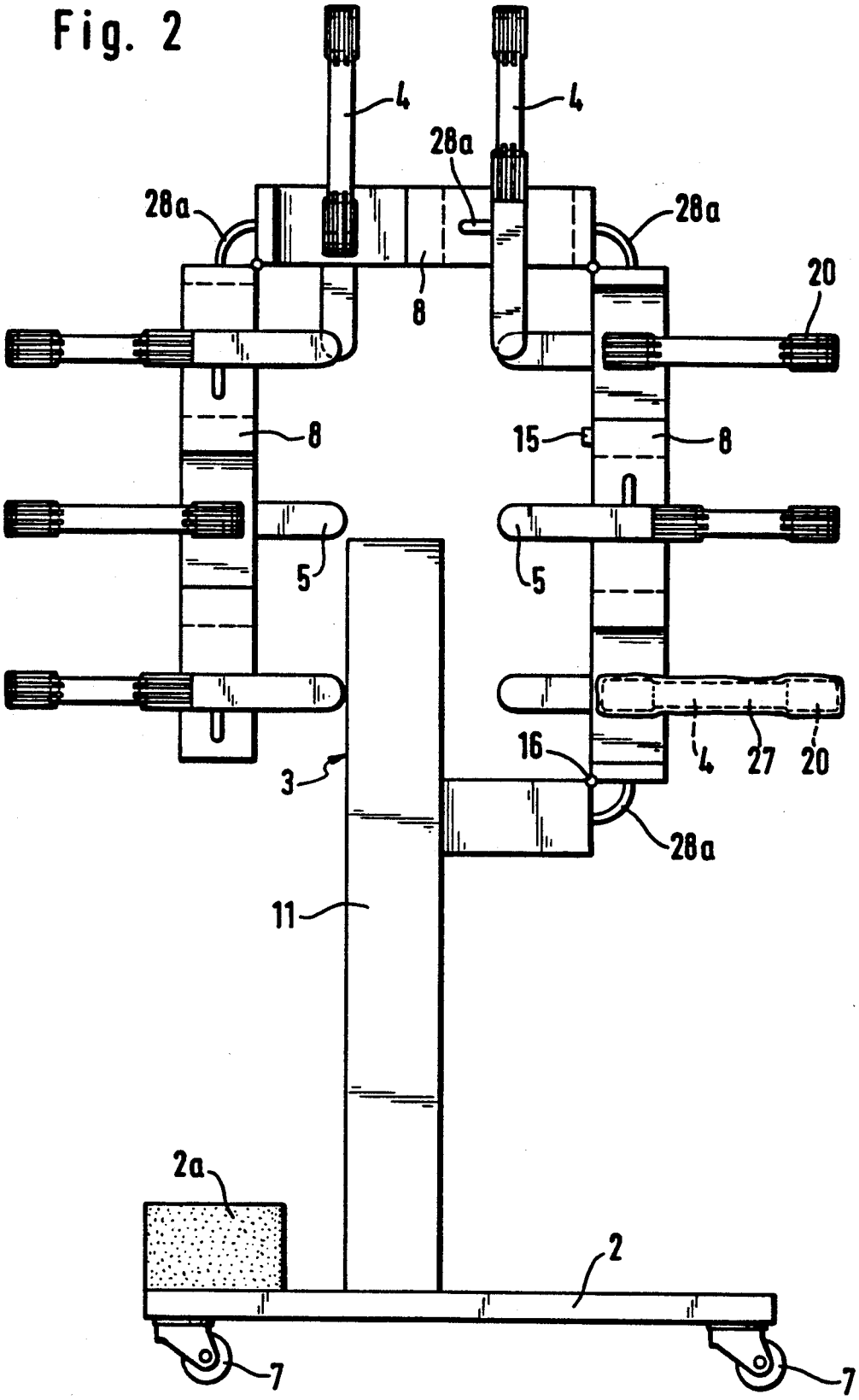
Figure 3:
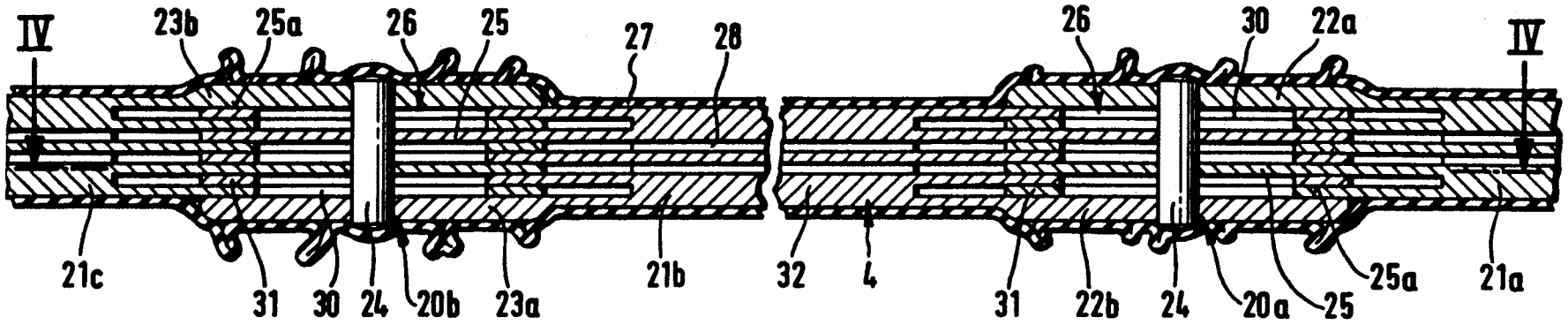
Figure 4:
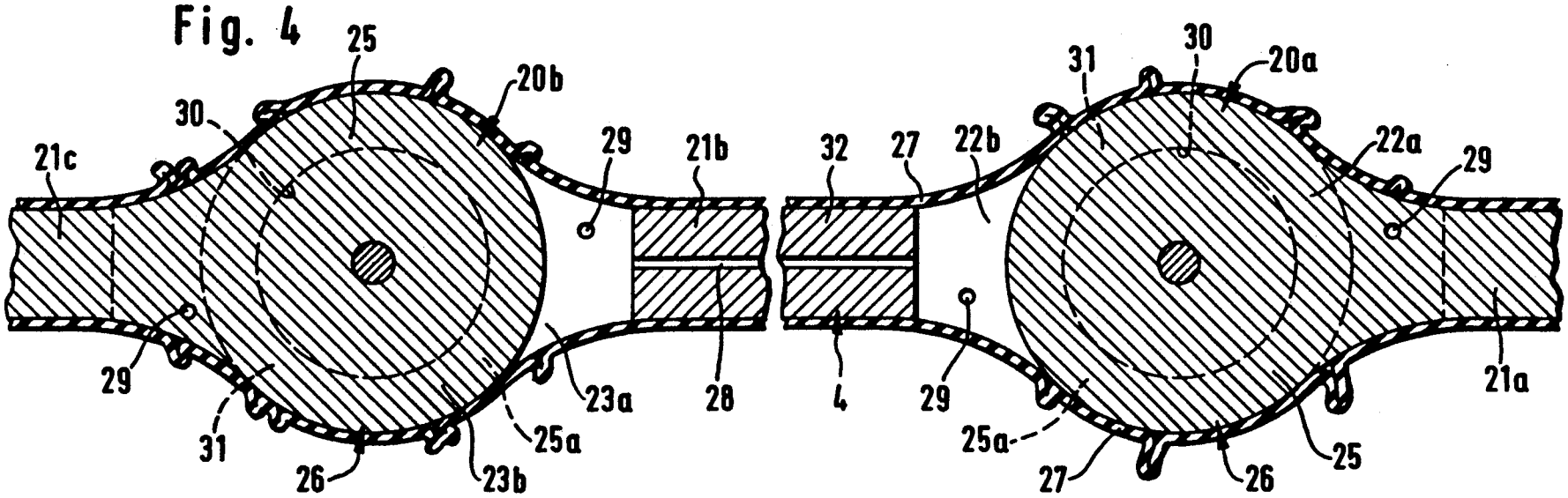
Figure 5:
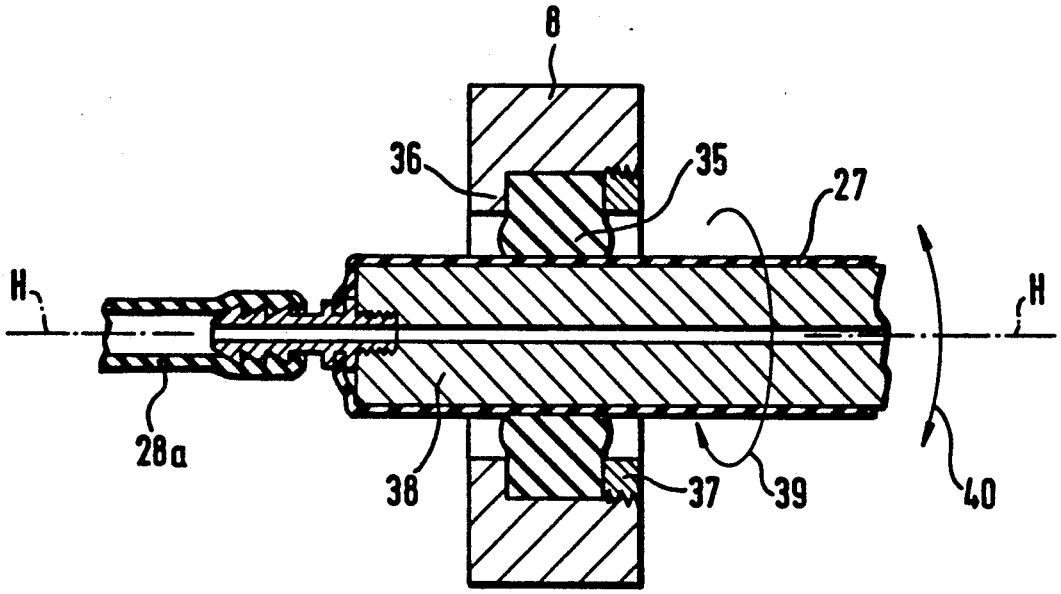

In what follows the invention is explained in greater detail by means of a form of construction represented schematically in the figures, which show:

FIG. 1 an appliance for lifting patients shown in perspective,

FIG. 2 the lifting appliance according to FIG. 1 in folded condition,

FIG. 3 a longitudinal section through a multi-hinge supporting arm,

FIG. 4 a section along the line IV—IV in FIG. 3,

FIG. 5 a section through a preferred form of fastening the supporting arms to a carrier beam.

Figure 6:
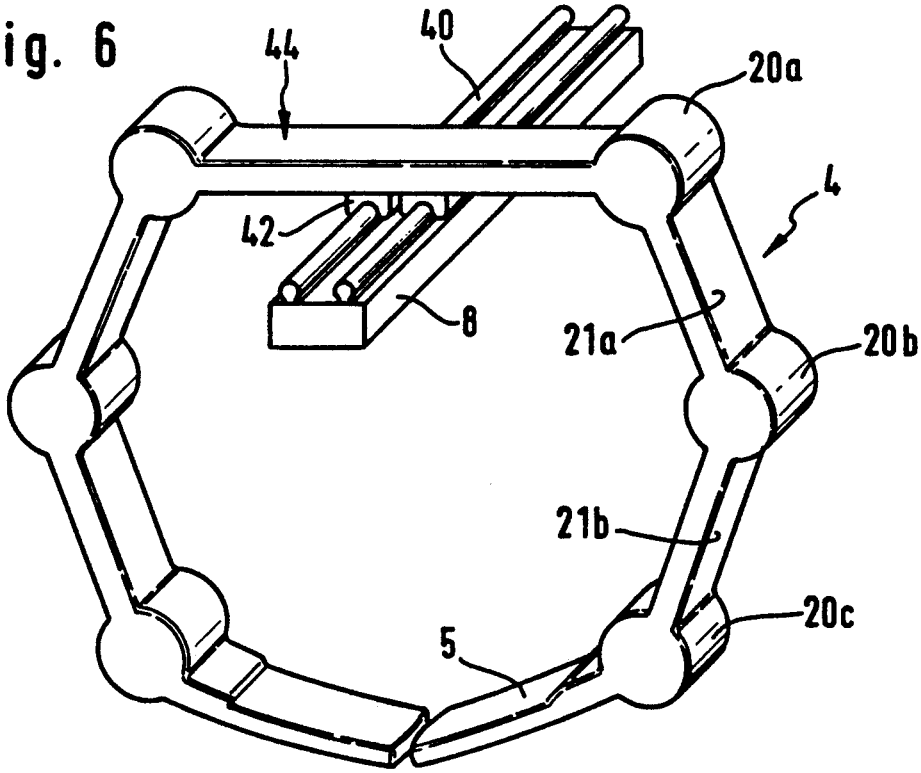

FIG. 6 a partial view in perspective of an alternative version of a carrier beam with supporting arms The patient-lifting appliance 1 shown in FIG. 1 has a base 2, a lifting arrangement as a whole numbered 3, and eight multi-hinge supporting arms 4 each with a support element 5, preferably in the form of a curved flat slat easy to insert under the patient 6, fastened to one end. The support elements intended for different regions of the patient's body may be individually shaped.

The base 2 is movable on rollers 7. The lifting arrangement 3 in the preferred form shown comprises a (longitudinal) beam 8 connected to the base 2 by a parallel-motion guide 9 and a lifting unit 13. The parallel-motion guide 9 consists of a parallel-sided frame 10 rigidly coupled to the beam 8, which is guided between two supporting columns 11 by means of roller or sliding bearings (not shown) so that it remains in a substantially horizontal position when moved upwards or downwards by the lifting unit 13. The lifting unit shown in this case is a pneumatic piston.

Details of the parallel-motion guide 9 and the lifting unit 13 are not of importance to the invention; the expert knows numerous possible ways of realising these. Also, it is not strictly necessary for the beam 8 to have absolutely parallel-motion guidance. A certain swinging component, for instance allowing the end of the beam remote from the base 2, to which the supporting arms 4 for the patients neck and head are attached, to be raised or lowered to a greater extent, can even be advantageous.

Particularly advantageous for the invention is a beam 8 for the supporting arms 4 in the form of a cantilever supported and fixed only at one end. This makes both construction and operation of the appliance easier. The length of the longitudinal beam 8 is matched approximately to the length of the patient's bed 12, the base 2 being positioned at the foot of the bed (not along its side). The effective length (that projecting over the patient's bed in the operating position) of the beam 8 is ideally slightly less than that of the bed.

FIG. 2 shows that the patient-lifting appliance 1 can advantageously be folded into a compact unit. The base 2 forms a movable trolley, which if desired may be enclosed by side walls not shown in the figure. The longitudinal beam 8 usefully has three hinges 16 to make it foldable. The supporting arms 4 in the stowed condition are turned-in close to the beam 8 and locked.

For use, the patient-lifting appliance is positioned at the foot of the patient's bed 12 (FIG. 1) in the condition shown in FIG. 2 with the beam folded and the arms against it; the longitudinal beam is then unfolded. A counterweight 2a is mounted on the base 2 to balance the weight of beam 8 and patient 6.

With the beam 8 in the operating position shown in FIG. 1 the hinged and easily adjustable supporting arms 4 allow the support elements 5 to be inserted easily and in succession into the correct position under the body of the patient 6. Once this has been done, the supporting arms 4 are locked (made rigid), the locking arrangement preferably being such that all supporting arms are locked simultaneously by means of a central actuating element, for instance by pressing an actuating button 15 fitted to the beam 8. The body of the patient can then be lifted with the aid of the lifting unit 3.

For positioning the support elements 5 as well as for lifting the patient 6 safely, it can be advantageous if the mountings of the supporting arms 4 in the beam 8 (henceforth referred to as pivot points 14) take the form of non-lockable flexible joints (additional to at least two lockable hinged joints per arm). Details are given further on.

FIGS. 3 and 4 show details of a particularly preferred version of the lockable supporting arms.

The multi-hinge supporting arms 4 each comprise several members 21a,21b,21c linked by hinges 20. The hinges shown are designated 20a,20b. Their ends joined by hinges are formed by the hinge elements 22a,22b,-23a,23b which the hinges 20a and 20b connect.

The hinge elements each comprise several alternately engaging circular discs rotatable about an axis 24, henceforth referred to as lamellae 25. The interlocking lamellae 25 together form a pack 26. If one of the hinges 20a,20b is moved, the facing surfaces of the lamellae 25 slide over each other. If the pack 26 is compressed, friction causes the hinge to lock. The annular surfaces sliding over each other are therefore designated locking surfaces 25a.

Compression of the pack 26 may be achieved in a variety of ways, for instance by means of threaded bolts concentric with the axis 24. Locking by means of a central actuating device may for example be achieved pneumatically or electromagnetically, each hinge 20 having a pneumatic piston and cylinder or an electromagnetic unit comprising an armature and windings, in each case so mounted (in a way familiar to the expert) that the packs 26 may be compressed by a central command. For safety reasons the design employed here should be such that the hinges 20 are compressed when the actuating device is in the inactive state and are released by activation of the energy source. This may, in ways also well known to the expert, be achieved by generating the force to compress the packs 26 with springs and countering it by means of the pneumatic or electromagnetic means mentioned.

Particularly preferred is the version of the lockable hinges shown in the figures, which is especially directed towards the requirements of applications in the field of medicine, where each multi-hinge supporting arm 4 is enclosed in a flexible, evacuable, sleeve 27 preferably of plastic foil. In each of FIGS. 1 and 2 the sleeve 27 is for simplicity's sake shown on only one supporting arm 4, but preferably all the supporting arms 4 are enclosed in such a sleeve.

In this form of construction the lamellae packs 26 are compressed by the external air pressure when the air inside the sleeve 27 is drawn off. In FIGS. 3 and 4 this evacuated condition is shown, with folds formed in the sleeve 27. In practice the formation of folds can substantially be avoided by the use of a tightly-fitting sleeve of a material with some degree of elasticity.

By evacuating the sleeves 27 all the hinges 20 of a supporting arm 4 are simply locked simultaneously Evacuation may be effected using a pump expediently fitted to the base 2, but a central vacuum line available in many hospitals may equally well be used.

Usefully channels 28 and cross-connections 29 are provided in the arms 4 so that the sleeve 27 can be evacuated easily and completely around the hinges 20. In FIG. 1 it can for instance be discerned how the vacuum channels 28 of the arms 4 are linked to a vacuum line running inside the beam 8 via vacuum hoses 28a. It is furthermore advantageous if a proportion of the lamellae 25, as mentioned above, have central recesses 30 so that only an outer ring 31 forms the locking surface 25a. In this way the pressure on the locking surface 25a for a given compression force is increased and concentrated on a zone relatively far from the axis 24, resulting in a high locking torque. If this version is chosen it must be ascertained that the cavities formed by the central recesses 30 can also be evacuated. This can be ensured for example by means of slits or notches, not shown in the figure, in the outer rings 31.

The swivelling range of the hinges is usefully limited by a swivelling stop not shown, to prevent excessive stretching of the sleeve 27.

The preferred multi-hinge supporting arms shown are simple in construction, reliable in operation and particularly easy to clean by virtue of their largely smooth surface. It can be useful to configure the members 21 of the arms 4 so as to produce a smooth external surface and preferably to have a substantially constant diameter.

The material of the members 21 of the supporting arms 4 should be strong and light. Furthermore the nature of the locking surfaces 25*a* should be such that friction between them is high. A suitable material for instance, is a layered composite using plywood, the individual lamellae 25 each consisting of a thin plywood disc which extends into the shaft 32 of the members 21.

Plastic materials also are suitable for the members 21 of the supporting arms, the locking surfaces 25*a* in this case possibly being roughened or having a friction-enhancing coating. The situation is similar where the members 21 are of metal. Of course the members 21 also need not be of the same material throughout; equally suitable is a combination, for instance of metal and plastic; the lamellae 25 are then preferably of metal.

It may be expedient to provide the members 21 of the supporting arms 4 with other coverings, not shown in the figures, in addition to the sleeve 27.

In particular the members 21 may have a protective coating of soft, shock-absorbing material inside the sleeve 27. For the sake of appearance and to facilitate cleaning of the supporting arms, an additional covering sleeve may be provided outside the evacuable sleeve 27. All coverings usefully enclose the supporting arms over their entire length from the beam 8 up to and including the last hinge (20*c* in FIG. 6) to which the support elements 5 are hinged. The support elements themselves however should remain free.

Preferably the supporting arms are, as shown in FIG. 1, so hinged suspended from the longitudinal beam 8, which in the operating position runs above the patient, that a proportion of the arms can be positioned to encircle the patient from each side. In the figure for instance four of the arms 4 encircle the patient 6 from his left; four others from his right. This increases the patient's safety.

A further preferred version has the pivot points 14 of the supporting arms 4 on the longitudinal beam 8 so transposed sideways relative to the latter's longitudinal axis L that the arms 4 encircling the patient each cross a plane running vertically through the longitudinal axis L. In the design shown in FIG. 1 this is achieved by having the beam 8 cranked and the pivot points 14 each on the far side of the longitudinal axis L when looked at from the side on which the arms encircle the patient 6. As a result there is a slight component of force in the direction of the body of the patient acting on each of the support elements 5, increasing the subjective and objective safety.

According to a further preferred version the pivot points of the multi-hinge supporting arms on the longitudinal beam 8 embody flexible joints with a degree of freedom of rotation about all three axes in space, so that the arms suspended from the beam 8 can be swivelled in all three directions in space. Such a version is shown in FIG. 5.

Joint bushes 35 of a rubber-elastic material are inserted in the beam 8, held between a land 36 and a locking ring 37. Engaging in that joint bush is a horizontal shaft 38 to which the supporting arm 4, not shown in FIG. 5, is attached. This simple design makes possible the desired swivelling characteristics about the horizontal axis H (arrow 39) as well as the degree of freedom to swivel about an axis parallel to the beam 8, symbolised by the double arrow 40. The third degree of freedom to swivel, about a vertical axis, is symbolised in FIG. 1 by the double arrow 41.

In the version shown in FIG. 5 the swivelling movement about the axis parallel to the beam and about the vertical axis is damped by the counter-force generated by the rubber-elastic joint bush 35 and the extent of swivelling limited. Regardless of the specific design of the pivot it is advantageous if such damping and limitation is provided, the angle of swivel in the directions in space indicated preferably being less than plus/minus 45 deg.

FIG. 6 shows an alternative version of a longitudinal beam 8 and the mounting of the supporting arms 4. Here, the beam 8 has slide rails 42*a*, along which the supporting arms 4 in pairs can be moved on sliders 42 which encircle the rails in such a way that the supporting-arm pair 44 slides without tilting.

The supporting arms 4 shown in FIG. 6 each have only three hinges 20*a*, 20*b*, 20*c*, each of which is lockable. If this minimum number of hinges is used, the length of each of the members 21*a*, 21*b* between the hinges 20*b*, 20*c* should be at least 25 cm. In general the length of the supporting arms from the beam 8 to the last hinge, to which the support element 5 is hinged, should be at least 80 cm.

I claim:

1. Apparatus for lifting or positioning a sick or handicapped person, comprising a base (2), a multiplicity of support elements (5) and a positioning device (3) connecting the elements (5) and the base (2), wherein at least a portion of the support elements (5) is fastened to multi-hinges (20), of which at least two are continuously lockable and comprise locking surfaces (25*a*) which slide over one another when the hinge is moved and locking of the hinges (20) is effected by pressing the locking surfaces (25*a*) against each other.

2. Apparatus according to claim 1, wherein the locking of the hinges (20) is actuated by an auxiliary energy source and is fitted with a central actuating unit (15) for locking the hinges (20) of at least one supporting arm (4).

3. Apparatus according to claim 1, wherein the positioning device comprises a carrier means (8) from which the multi-hinge supporting arms (4) are suspended.

4. Apparatus according to claim 3, wherein the carrier means is formed as a longitudinal beam which in the operating position of the apparatus extends over the patient (6) and has the multi-hinge supporting arms (4) so fixed to the carrier means (8) that each of the multi-hinge supporting arms can be positioned to encircle the person (6) from one side.

5. Apparatus according to claim 4, wherein the pivot points (14) of the multi-hinge supporting arms (4) on the carrier means (8) comprise flexible joints having degrees of freedom of rotation (39,40,41) about all three axes in space and where the pivot points (14) of the multi-hinge supporting arms (4) on the carrier means (8) are so displaced sideways relative to the latter's longitudinal axis (L) that the multi-hinge supporting arms (4) encircling the patient (6) each cross a vertical plane through the longitudinal axis (L).

6. Apparatus according to claim 1, wherein the multi-hinge supporting arms have at least three lockable hinges.

7. Apparatus according to claim 1, wherein the locking surfaces (25a) are formed as a ring.

8. Apparatus according to claim 1, wherein the locking mechanism is actuated pneumatically.

9. Apparatus according to claim 1, wherein at least one of the supporting arms is sheathed with a flexible evacuable sleeve (27).

10. Apparatus according to claim 1, wherein the lockable hinges (20) are formed as a lamellar hinge, the hinge elements (22) of a hinge each having a multiplicity of interlocking lamellar discs (25) rotatable about a common axis (24), forming a lamellae pack (26), and where locking of the hinge (20) is effected by pressing together the lamellae pack (26).

11. Apparatus for lifting or positioning a sick or handicapped person or medical auxiliary devices, with a supporting arm having several lockable hinges, wherein two connected hinge elements of at least one of the lockable hinges (20) comprise locking surface (25a) which slide over one another when the hinge is moved and locking of the hinges (20) is effected by pressing the locking surfaces (25a) against each other.

12. Apparatus according to claim 11, wherein the locking surfaces (25a) are formed as a ring.

13. Apparatus according to claim 11, wherein the locking mechanism is actuated pneumatically.

14. Apparatus according to claim 11, wherein at least one of the supporting arms is sheathed with a flexible evacuable sleeve (27).

15. Apparatus according to claim 11, wherein the lockable hinges (20) are formed as a lamellar hinge, the hinge elements (22) of a hinge each having a multiplicity of interlocking lamellar discs (25) rotatable about a common axis (24), forming a lamellae pack (26), and where locking of the hinge (20) is effected by pressing together the lamellae pack (26).

16. Apparatus for lifting or positioning a sick or handicapped patient, comprising a base (2), a multiplicity of support elements (5) and a positioning device (3) connecting the elements (5) and the base (2), wherein at least a portion of the support elements (5) is fastened to multi-hinge supporting arms (4) each having at least three hinges (20), at least two of which are pivotable relative to one another about axes running in the operating position of the apparatus essentially parallel to the longitudinal axis of the patient and which are continuously lockable;

and the positioning device comprises carrier means (8) from which the multi-hinge supporting arms are suspended and which comprises a longitudinal beam which in the operating position of the apparatus extends over the patient (6) and has the multi-hinge supporting arms (4) fixed to the carrier means (8) such that each of the multi-hinge supporting arms are positionable to encircle the patient (6) from one side, whereby the support elements are insertable under the patient at the angle required by the patient's position.

17. Apparatus according to claim 16, wherein the locking of the hinges (20) is actuated by an auxiliary energy source and is fitted with a central actuating unite (15) for locking the hinges (20) of at least one supporting arm (4).

18. Apparatus according to claim 16, wherein the multi-hinge supporting arms have at least three lockable hinges.

19. Apparatus according to claim 16, wherein the two connected hinge elements of at least one of the lockable hinges (20) comprise locking surfaces (25a) which slide over one another when the hinge is moved and locking of the hinges (20) is effected by pressing the locking surfaces (25a) against each other.

20. Apparatus according to claim 19, wherein the locking surfaces (25a) are formed as a ring.

21. Apparatus according to claim 19, wherein the locking mechanism is actuated pneumatically.

22. Apparatus according to claim 19, wherein the lockable hinges (20) are formed as a lamellar hinge, the hinge elements (22) of a hinge each having a multiplicity of interlocking lamellar discs (25) rotatable about a common axis (24), forming a lamellae pack (26), and where locking of the hinge (20) is effected by pressing together the lamellae pack (26).

* * * * *